United States Patent [19]

Kane et al.

[11] 4,184,134

[45] Jan. 15, 1980

[54] ELECTRICAL SWITCHING APPARATUS HAVING CONVERTIBLE CONTACT STRUCTURE

[75] Inventors: Hugh Kane, Chagrin Falls; Bruce A. Oellerich, Mentor, both of Ohio

[73] Assignee: Clark Control, Inc., Cleveland, Ohio

[21] Appl. No.: 933,320

[22] Filed: Aug. 14, 1978

[51] Int. Cl.[2] ..... H01H 1/58

[52] U.S. Cl. ..... 335/198; 200/281; 200/307; 335/132

[58] Field of Search ..... 335/198, 197, 280, 105, 335/98, 132; 200/281, 307

[56] References Cited

U.S. PATENT DOCUMENTS

| | | | |
|---|---|---|---|
| 3,238,341 | 12/1963 | Haydu | 335/132 |
| 3,437,773 | 4/1969 | Koertge | 335/132 |
| 3,451,018 | 6/1969 | DiMarco | 335/197 |
| 3,832,657 | 8/1974 | Hardman et al. | 335/198 |
| 4,087,770 | 5/1978 | Kuhn et al. | 335/197 |

*Primary Examiner*—Harold Broome
*Attorney, Agent, or Firm*—David M. Keay

[57] ABSTRACT

Electromagnetically operated contactor employing contact modules which are converted from normally open to normally closed and from normally closed to normally open operation by inverting the contact module in the contactor. The contact terminals of the contact module are clamped by various arrangements against conductive members of the contactor. Wiring terminals for connecting external wiring to the conductive members are spaced from the arrangement for clamping the contact terminals to the conductive members. Thus, the wiring terminals and the external wiring do not interfere with the module or arrangement for clamping, and the module may be removed, inverted, and replaced without disturbing the external wiring connections.

10 Claims, 10 Drawing Figures

ELECTRICAL SWITCHING APPARATUS HAVING CONVERTIBLE CONTACT STRUCTURE

BACKGROUND OF THE INVENTION

This invention relates to electrical switching apparatus. More particularly, it is concerned with electromagnetically operated switching apparatus employing convertible contact modules which operate in either a normally open or normally closed condition depending upon their mounting position.

Electrical switching apparatus such as electromagnetic contactors for opening and closing a plurality of switches are well-known. In order to provide versatility contactors of this general type frequently employ switch or contact modules which selectively may be changed to function in either the normally open or normally closed condition. Certain contactors are designed to employ convertible contact modules which when placed in the contactor in one position provide a normally open switch, and when removed and replaced in a different position provide a normally closed switch. With contactors of this type heretofore available, however, it was necessary to disconnect the external wiring in order to remove and convert a contact module. Time was required to disconnect and reconnect the wiring, and in addition there was the possibility of making errors when reconnecting the external wiring.

SUMMARY OF THE INVENTION

Switching apparatus permitting rapid error free conversion of contact modules is provided by electrical switching apparatus in accordance with the present invention. The apparatus employs a convertible contact module which selectively provides either normally open or normally closed contact operation. The apparatus includes supporting structure with a contact actuator mounted in the supporting structure for reciprocal movement. A convertible contact module having exterior first and second contact terminals is adapted to be removably mounted in the supporting structure in engagement with the contact actuator. The convertible contact module is mounted in either of two positions which respectively provide normally open and normally closed contact conditions between the two contact terminals. Mounted on the supporting structure are first and second conductive members each having a contact region for making contact with a contact terminal of the convertible contact module when the convertible contact module is mounted in the supporting structure in either of the two positions. Holding means releasably hold the convertible contact module in the supporting structure in either of the two positions with the contact terminals making electrical contact with the contact regions of the conductive members. Connecting means on the conductive members permit external electrical connections to be made to the conductive members. Each connecting means is spaced from the associated contact region and from the holding means so that when the convertible contact module is released by the holding means, removed from the supporting structure, and changed from one position to the other the connecting means and the external connections thereto do not interfere with release and movement of the convertible contact module and in addition the connecting means and external connections are not disturbed.

For a better understanding of the present invention, together with other and further objects, advantages, and capabilities thereof, reference is made to the following discussion and appended claims in connection with the above-described drawings.

DETAILED DESCRIPTION OF THE INVENTION

Figure 1:
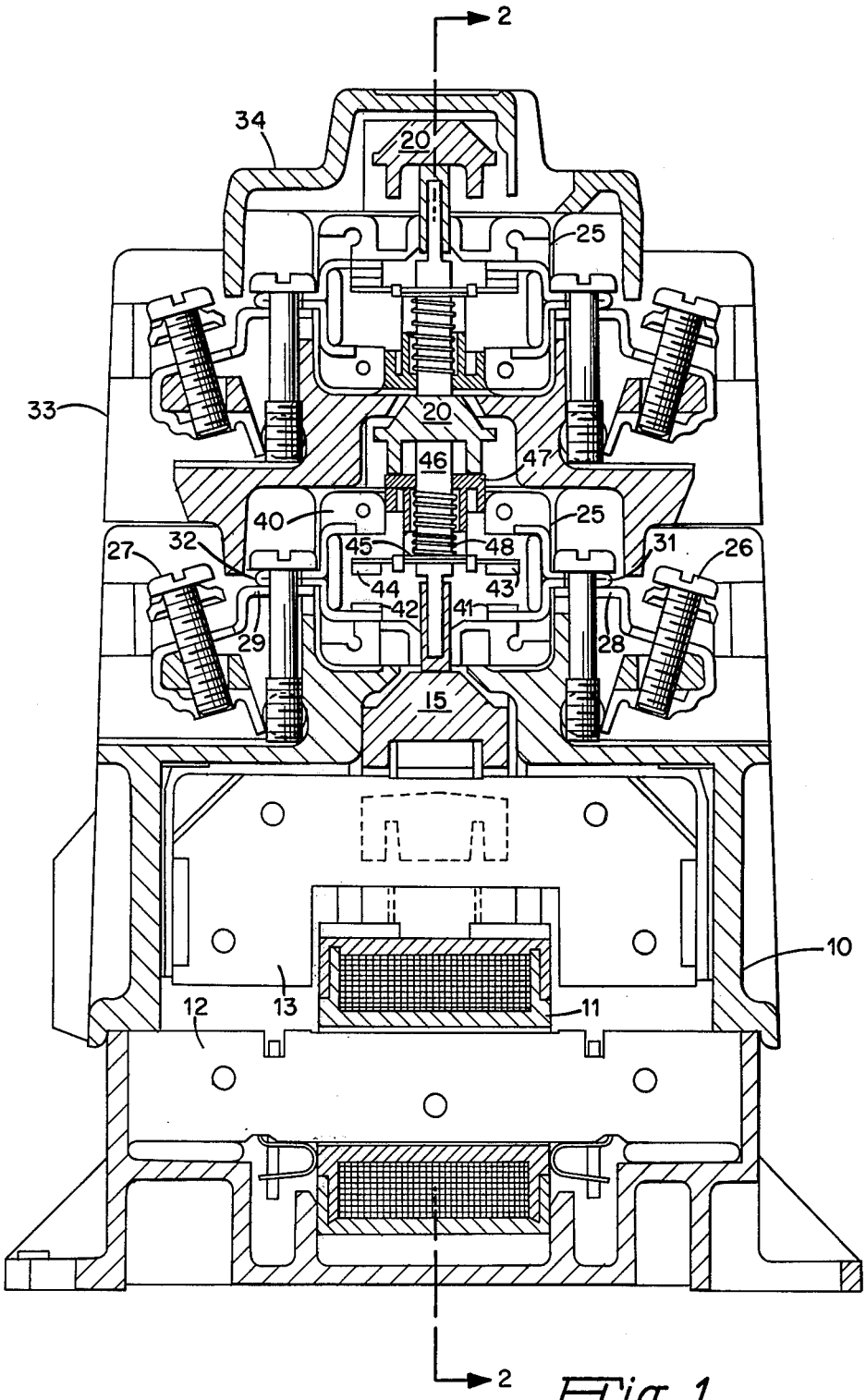
FIG. 1 is a cross-sectional view of an electric magnetically operated contactor in accordance with the present invention.
Figure 2:
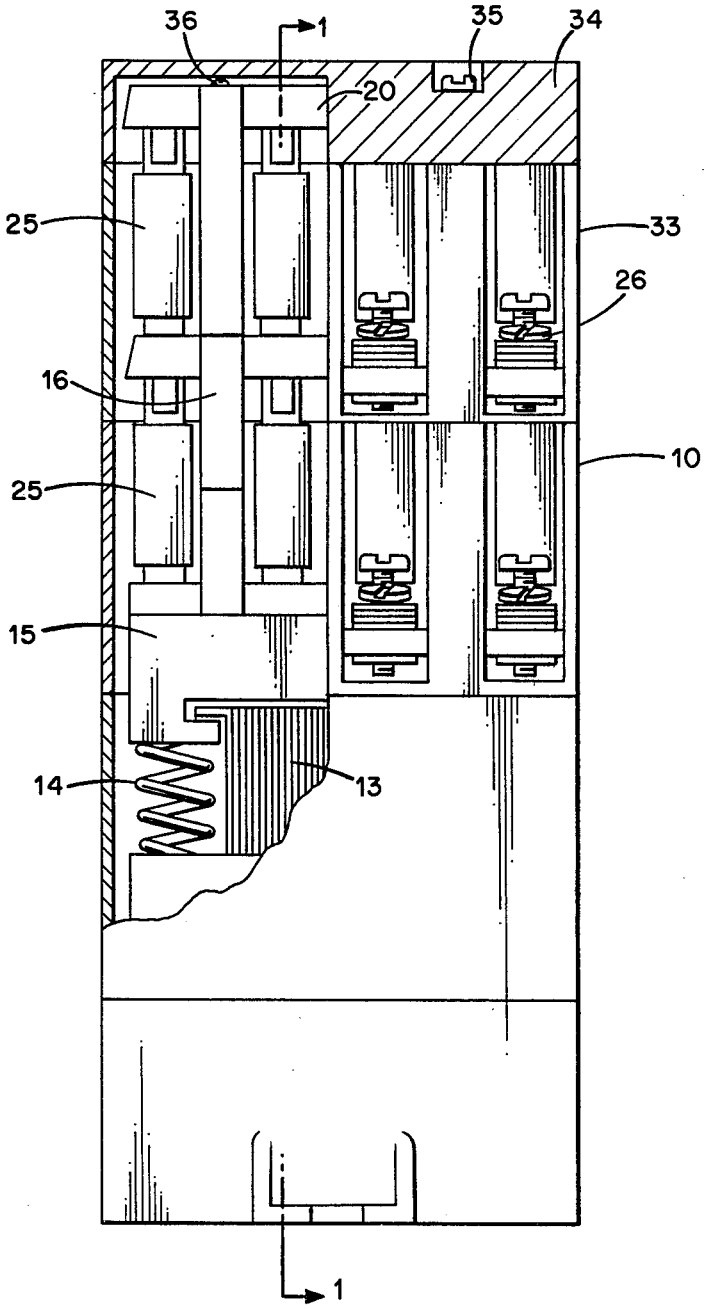
FIG. 2 is a view of the contactor of FIG. 1 partially in cross-section taken generally along the line 2—2 of FIG. 1.

A contactor in accordance with the present invention for simultaneously switching up to eight circuit paths is illustrated in FIGS. 1 and 2. An electromagnet coil 11 having a core 12 is located against the housing 10 of the contactor. A movable armature 13 is mounted adjacent to the electromagnet coil 11 for reciprocal movement. In the deenergized condition the armature 13 is biased in an upper position as shown in FIGS. 1 and 2 by compression springs 14. When the electromagnet coil 11 is energized the armature 13 is moved downward. The elements of the electromagnet and the manner in which they are mounted in the housing structure are the subject matter of an invention of Robert W. Weeks which is described in detail and claimed in his copending application entitled "Electromagnetic Switching Apparatus," Ser. No. 050,000, filed June 18, 1979, and assigned to the assignee of the present application. Attached to the armature 13 is a carrier 15 on which vertically extending contact actuator rods 16 are mounted. Lateral members 20 extend from the rods and thus move with the armature 13. The lateral members 20 of the actuator rods 16 engage convertible contact modules 25 as will be explained in greater detail hereinbelow.

Eight pairs of wiring terminals 26, 27 to which external electrical wiring may be attached are mounted in the housing 10. Extending from the terminals are conductive members 28 and 29. Identical convertible contact modules 25 are removably mounted within the housing with their terminals 31 and 32 in electrical and mechanical contact with contact regions of the conductive members 28 and 29.

In the contactor as shown four sets of wiring terminals 26, 27 and conductive members 28, 29 are positioned at a first level in the housing for receiving four contact modules 25. This arrangement is duplicated at a second level in an upper section 33 of the housing. If desired, a third level may be added. A cover section 34 is positioned on the upper section of the housing. The cover section 34, upper section 33 of the housing, and upper and lower portions of the contact actuator rods 16 and lateral members 20 may readily be disassembled as necessary to provide access to the second and to the first levels of contact modules. The cover section 34 and upper section 33 of the housing are held in place by removable bolts 35 (FIG. 2). The upper and lower portions of the contact actuator rods 16 and lateral members 20 are removably mounted to the carrier 15 by bolts 36 passing centrally through the rods to the carrier.

The details of each of the identical contact modules 25 are shown in FIG. 1. The contact module at the lower level is positioned so as to provide normally open contacts (electromagnet coil 11 deenergized). The contact module at the upper level is inverted from the one at the lower level and functions in the normally closed condition.

The contact modules 25 are identical. Each includes a housing 40 of generally rectangular parallelopiped configuration. The contact terminals 31 and 32 extend through the housing 40 between the interior and exterior of the module housing. The terminals 31 and 32 are equidistant from the top and bottom surfaces of the housing. The opposite surfaces of each terminal are flat and parallel, and the corresponding upper and lowr surfaces of the two terminals are in the same plane. An open slot extends horizontally along the portion of each contact terminal. A pair of stationary contacts 41 and 42 are mounted on the inner portions of the terminals 31 and 32. A mating pair of movable contacts 43 and 44 are carried on a conductive contact bridge 45. The bridge 45 with movable contacts 43 and 44 is mounted on a plunger 46 so as to permit limited movement with respect thereto. The plunger is mounted in the housing 40 so as to move reciprocally and protrude through openings in the top and bottom walls of the module housing. The plunger 46 extends through a central opening in a movable seat 47 which is also mounted in the housing 40 so as to permit reciprocal movement. A compression spring 48 is compressed between the movable seat 47 and the contact bridge 45.

The modules 25 are fastened in place (as will be explained in detail hereinbelow) in either one of the two inverted positions illustrated in FIG. 1 to provide either normally open or normally closed operation. When the contactor is completely assembled the lateral members 20 of the contact actuator rods 16 engage the movable plunger 46 and seat 47 as shown for each contact condition. Movement of the lateral members 20 downward in response to energizing of the electromagnet coil 11 also moves the plunger 46 and seat 47 of a module 25 in the normally open condition as shown at the lower level downward permitting compression spring 48 to close the contacts. The plunger 46 of a module in the normally closed condition as shown at the upper level in FIG. 1 is also moved downward opening the contacts and compressing the compression spring 48.

Figure 3B:
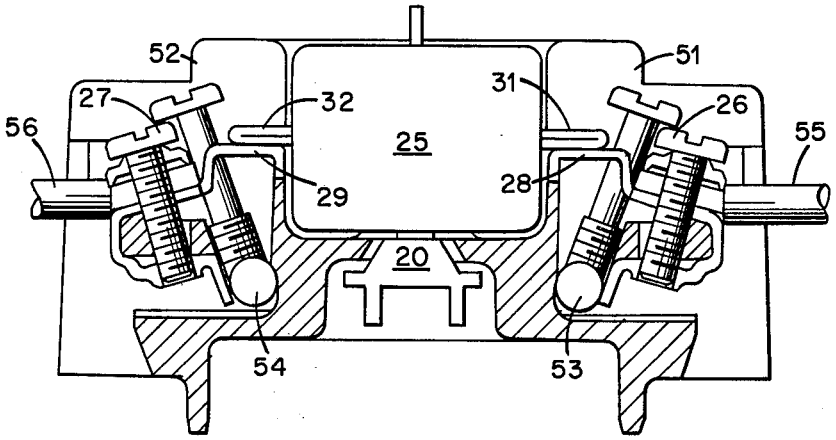
FIGS. 3A and 3B are fragmentary views partially in cross-section of the contactor of FIGS. 1 and 2 illustrating in detail the manner of connecting and mounting convertible contact modules in the contactor.
Figure 3A:
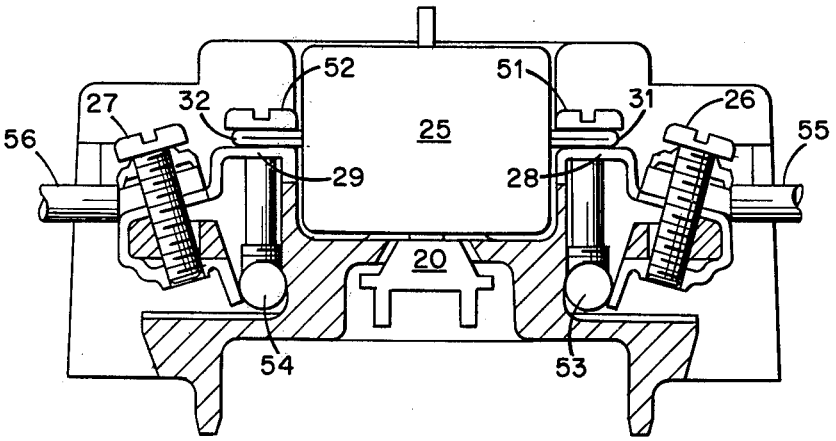

The manner in which a module 25 is mounted in the contactor in electrical connection with the wiring screw terminals 26 and 27 is shown in detail in FIGS. 3A and 3B. As illustrated in FIG. 3A the module 25 fits in the housing with the contact terminals 31 and 32 against the contact regions of the conductive members 28 and 29, respectively. The contact terminals 31 and 32 are clamped against the conductive members 28 and 29 by an arrangement of screws 51 and 52 threaded into mating openings in pivotal retaining rods 53 and 54, respectively. The screws 51 and 52 pass through the open slots in the contact terminals 31 and 32 and aligned slots in the conductive members 28 and 29. The pivotal retaining rods 53 and 54 are mounted in the contactor so as to permit limited pivotal movement. When the screws 51 and 52 are tightened, the module is held fixed in the housing with the contact terminals 31 and 32 making physical and electrical contact with the conductive members 28 and 29. Electrical wires 55 and 56 are connected to the conductive members by the wiring screw terminals 26 and 27.

In order to convert the contact module 25 as shown in FIG. 3A from the normally opened to the normally closed or from the normally closed to the normally opened condition, the arrangement as shown in FIG. 3A is exposed by removing the cover 34 and, if appropriate, the second section 33 of the housing in addition to the upper portions of the contact actuator rods 16 and lateral members 20. In order to unclamp the module the screws 51 and 52 are loosened. After the screws 51 and 52 are unthreaded sufficiently, they are pivoted outwardly about the retaining rods 53 and 54 as shown in FIG. 3B. The screws may be held captive in the rods in order to prevent inadvertent removal from the rods. Sideway movement of the screws is permitted by the open slots in the contact terminals 31 and 32 and the slots in the conductive members 28 and 29. When the heads of the screws clear the contact terminals 31 and 32 sufficiently, the module 25 may be removed as by lifting out directly or by tipping and lifting out.

The contact module may then be inverted and replaced in the housing in position as shown in FIG. 3B. (The module may contain suitable indicia indicating which position is normally open and which is normally closed.) Since the module is generally symmetrical about the contact terminals 31 and 32 and the opposed surfaces of the terminals are flat and parallel, there is essentially no mechanical difference as to whether the module is mounted in one position or its inverse. After the module is replaced in the housing, the screws 51 and 52 are pivoted inwardly into position and tightened to clamp the module as shown in FIG. 3A. As can be appreciated from FIGS. 3A and 3B, during the procedure of removing, converting, and replacing the module, the wiring 55 and 56 and the wiring terminals 26 and 27 are not disturbed.

Figure 4A:
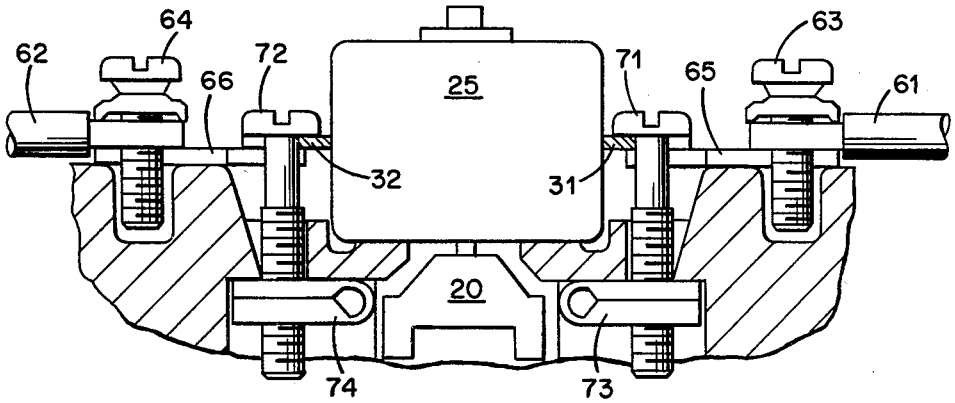
FIGS. 4A and 4B are fragmentary views partially in cross-section illustrating a modification of the structure for mounting and connecting convertible contact modules in a contactor.
Figure 4B:
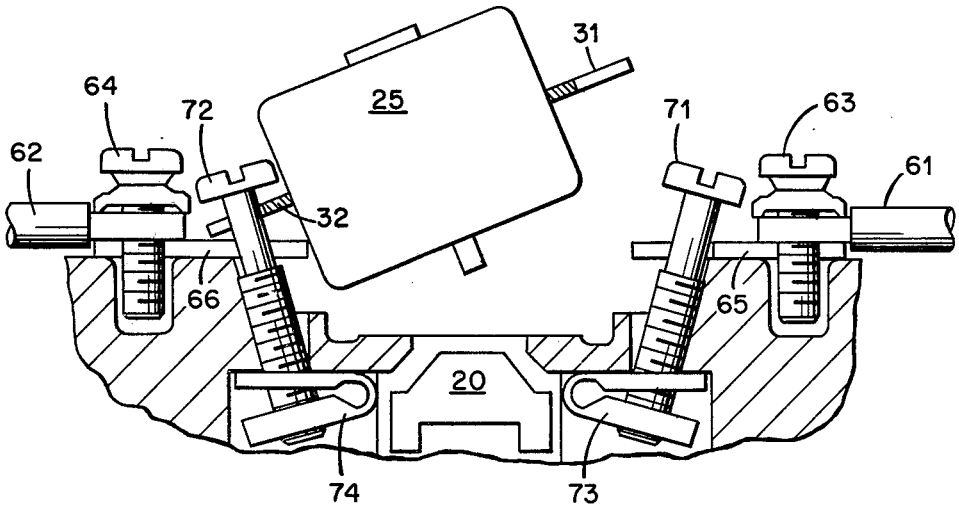

A modification of the arrangement for holding the contact module in position and making electrical connection thereto is illustrated in FIGS. 4A and 4B. The contact modules 25 are identical with those employed in the previously discussed embodiment. In the modification shown in FIGS. 4A and 4B wires 61 and 62 are held by wiring terminals 63 and 64 in conductive members 65 and 66, respectively. Clamping screws 71 and 72 are threaded into the lower portions of folded hinging elements 73 and 74 which desirably may be of plastic in order to provide resilience.

In order to remove the module as for the purpose of changing the normal contact condition the screws 71 and 72 are loosened. When unthreaded sufficiently but still retained in the hinging elements, the screws pivot outwardly as illustrated in FIG. 4B. This action is permitted by the open slots in the contact terminals 31 and 32, aligned slots in the conductive members 65 and 66, and clearance openings in the upper portions of the hinging elements 73 and 74, respectively. The resilience of the plastic hinging elements 73 and 74 biases the screws 71 and 72 outward to the positions shown in FIG. 4B.

The module 25 may then be removed as by tipping and lifting out, inverted, and replaced in position on the conductive members 65 and 66. Each screw 71 and 72 is urged into its upright position, and tightened as shown in FIG. 4A. Thus the module may be inverted from one position to the other without interfering with the electrical connections to the wiring terminals.

Figure 5:
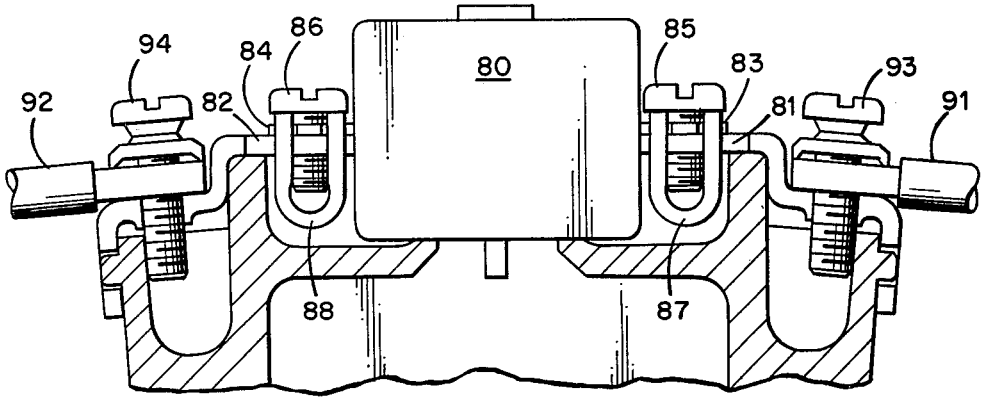
FIG. 5 is a fragmentary view partly in cross-section illustrating another modification of the mounting and connecting structure employed with a modified convertible contact module.
Figure 8:
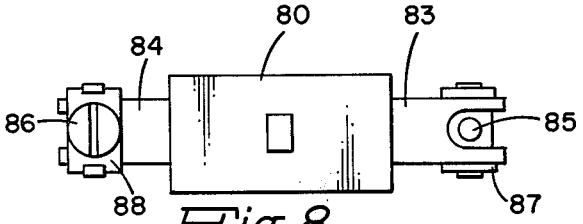
FIGS. 6, 7, and 8 are additional views of the convertible contact module employed in the modification of FIG. 5.
Figure 6:
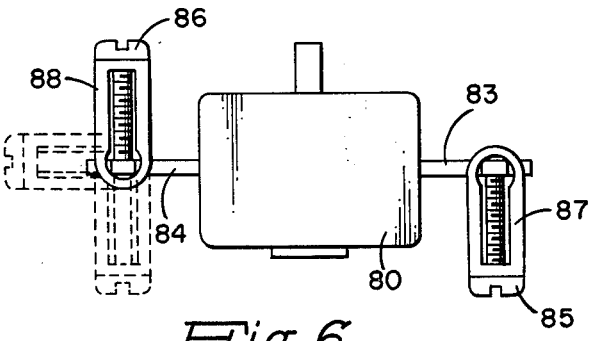
Figure 7:
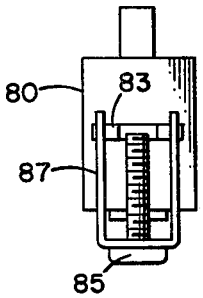

FIG. 5 illustrates a further modification of the contactor in accordance with the present invention employing a modified contact module 80. Electrical wires 91 and 92 are connected to conductive members 81 and 82 by wiring terminals 93 and 94, respectively. In this version the conductive members 81 and 82 are reduced in width in the region in contact with the contact terminals 83 and 84 of the module. A threaded hole is provided in each of these regions. The structure of the module 80 adapted for mating with the conductive members 81 and 82 is best shown in the elevational, side, and plan views, FIGS. 6, 7, and 8, respectively, of the module.

Screws 85 and 86 which clamp the contact terminals 83 and 84 against the conductive members 81 and 82 are pivotally held in the contact module. Each screw 85 and 86 is captively mounted for rotation in U-shaped members 87 and 88. The arms of the U-shaped members are slotted to receive tabs extending from the side edges of the contact terminals 83 and 84. The contact terminals 83 and 84 each have open slots along the portion of their major axis.

As shown in FIG. 5, the module 80 is fastened in place by screws 85 and 86 threaded into mating threaded openings in conductive members 81 and 82 to clamp the contact terminals 83 and 84 against the conductive members 81 and 82, respectively. The arms of the U-shaped members 87 and 88 fit on opposite sides of the regions of the conductive members of reduced width.

The module 80 is removed from its position by completely unthreading the screws 85 and 86 from the conductive members 81 and 82. The module is then removed from the contactor and inverted. The U-shaped members 87 and 88 are then positioned with the tabs of the contact terminals 83 and 84 at the bottom of the slots in the arms of the U-shaped members. The U-shaped members and captive screws are then pivoted through 180° as illustrated by the phantom showing in FIG. 6. With the U-shaped members and captive screws reversed, the module is repositioned in the housing, and the screws 85 and 86 tightened. The module is clamped in position as shown in FIG. 5 with the contact terminals 83 and 84 in contact with the conductive members 81 and 82. Thus, this modification also provides for quick and easy removal and inverting of the contact modules in order to convert the operating condition of the contacts without interfering with the external electrical connections to the wiring terminals.

While there has been shown and described what are considered preferred embodiments of the present invention, it will be obvious to those skilled in the art that various changes and modifications may be made therein without departing from the invention as defined by the appended claims.

What is claimed is:

1. An electrical switching apparatus having a convertible contact module for selectively providing normally open or normally closed contact operation comprising supporting structure;

a contact actuator mounted in said supporting structure and reciprocally movable with respect thereto;

a convertible contact module having first and second contact terminals on the exterior thereof, said convertible contact module being removably mounted in said supporting structure in engagement with said contact actuator in either of two positions respectively providing normally open and normally closed contact conditions between said contact terminals;

first and second conductive members mounted on said supporting structure, each having a contact region for making contact with a contact terminal of the convertible contact module when the convertible contact module is mounted in the supporting structure in either of said two positions;

holding means for releasably holding the convertible contact module in the supporting structure in either of said two positions with the contact terminals of the convertible contact module making electrical contact with the contact regions of the conductive members; and first and second connecting means on said first and second conductive members, respectively, for permitting external connections to said conductive members, each connecting means being spaced from the associated contact region and from the holding means whereby when said convertible contact module is released by said holding means, removed from the supporting structure, and changed from one position to the other, the connecting means and external connections made thereto do not interfere with release and movement of the convertible contact module and are not disturbed.

2. An electrical switching apparatus in accordance with claim 1 wherein said contact actuator is reciprocally movable between two spaced positions;

said convertible contact module includes a housing, said contact terminals being mounted on said housing at opposite sides thereof and extending outwardly from said housing, said contact terminals passing through the housing to the interior thereof, and contact elements within said housing engaging said contact actuator when the convertible contact module is mounted in the supporting structure in either first or second respectively inverted positions, the convertible contact module being in a normally open condition with the contact elements providing an open circuit between the contact terminals when mounted in one position and being in a normally closed condition with the contact elements providing a closed circuit between the contact terminals when mounted in the other position; and said contact actuator moves the contact elements to produce a closed circuit between the contact terminals of a convertible contact module in the normally open condition upon movement from one spaced position to the other spaced position, and moves the contact elements to produce an open circuit between the contact terminals of a convertible contact module in the normally closed condition upon movement from the one spaced position to the other spaced position.

3. An electrical switching apparatus in accordance with claim 2 wherein the portion of each contact terminal of the convertible contact module exterior of the housing has generally flat planar opposite surfaces, and the corresponding surfaces of the two contact terminals lie generally in the same plane; and the contact regions of the two conductive members lie generally in the same plane whereby when the convertible contact module is mounted in the supporting structure in either of the two inverted positions, a surface of each contact terminal is in electrical contact with a contact region of a conductive member.

4. An electrical switching apparatus in accordance with claim 3 wherein said housing means for releasably holding the convertible contact module in the supporting structure includes fastening means for releasably clamping each contact terminal against the contact region of a conductive member.

5. An electrical switching apparatus in accordance with claim 4 wherein said fastening means includes first and second binding means associated with the first and second conductive members, respectively;

each binding means is movably mounted in the supporting structure for movement between a first position in which the associated contact terminal is clamped against the contact region of the associated conductive member and a second position in which the convertible contact module is released for removal from the supporting structure;

the first and second connecting means are spaced from the first and second binding means, respectively, whereby the connecting means do not interfere with the binding means in the first or in the second position.

6. An electrical switching apparatus in accordance with claim 5 wherein said fastening means includes retaining means mounted in said supporting structure and coupled to said binding means for permitting movement of the binding means between said first and second positions while retaining the binding means in the supporting structure.

7. An electrical switching apparatus in accordance with claim 6 wherein each of the contact terminals has a slot therein;

each of the conductive members has a slot therein in the contact region;

the slot in each contact terminal overlies a portion of the slot in the associated conductive member when the convertible contact module is mounted in the supporting structure in said first or second position;

each binding means extends through the slots in the contact terminal and in the associated conductive member and engages said retaining means;

each binding means and retaining means is operable to clamp the associated contact terminal against the contact region of the associated conductive member when the binding means is in a tightened condition;

the retaining means is operable to permit pivotal movement of the binding means along the direction of the slots when the binding means is in a loosened condition; and the slot in each conductive member permits pivotal movement of the loosened binding means to a release position permitting removal of the convertible contact module from the supporting structure.

8. An electrical switching apparatus in accordance with claim 7 wherein each binding means is a threaded screw having an enlarged head portion and a threaded portion; and each retaining means has a threaded opening for mating with the threaded portion of said threaded screw.

9. An electrical switching apparatus in accordance with claim 4 wherein said fastening means includes clamping means rotatably mounted on each of the contact terminals, clamp engaging means associated with each of the conductive members for releasably engaging the associated clamping means, said clamping means being rotatable from a first position permitting engagement of the clamping means and the clamp engaging means to hold the convertible contact module in said first position, to a second position permitting engagement of the clamping means and the clamp engaging means to hold the convertible contact module in said second position.

10. An electrical switching apparatus in accordance with claim 9 wherein each clamping means includes a threaded screw having an enlarged head portion and a threaded portion; and each clamp engaging means has a threaded opening for mating with the threaded portion of said threaded screw.

* * * * *

REEXAMINATION CERTIFICATE (182nd)

United States Patent [19] [11] B1 4,184,134

Kane et al. [45] Certificate Issued Mar. 27, 1984

[54] ELECTRICAL SWITCHING APPARATUS HAVING CONVERTIBLE CONTACT STRUCTURE

[75] Inventors: Hugh Kane, Chagrin Falls; Bruce A. Oellerich, Mentor, both of Ohio

[73] Assignee: GTE Products Corp., Waltham, Mass.

Reexamination Request:
No. 90/000,323, Feb. 4, 1983

Reexamination Certificate for:

| | |
|---|---|
| Patent No.: | **4,184,134** |
| Issued: | **Jan. 15, 1980** |
| Appl. No.: | **933,320** |
| Filed: | **Aug. 14, 1978** |

[51] Int. Cl.[3] ..... H01H 1/58
[52] U.S. Cl. ..... 335/198; 200/281; 200/307; 335/132
[58] Field of Search ..... 335/132, 198, 197; 200/281, 307

[56] References Cited

U.S. PATENT DOCUMENTS

| | | | |
|---|---|---|---|
| 2,924,685 | 2/1960 | Burch | 335/132 |
| 3,238,341 | 12/1963 | Haydu | 335/132 |
| 3,324,431 | 6/1967 | Cataldo et al. | 335/132 |
| 3,437,773 | 4/1969 | Koertge | 335/132 |
| 3,451,018 | 6/1969 | Di Marco | 335/197 |
| 3,813,621 | 5/1974 | Blum | 335/198 |
| 3,832,657 | 8/1974 | Hardman et al. | 335/198 |
| 3,835,425 | 9/1974 | Karch et al. | 335/132 |
| 4,087,770 | 5/1978 | Kuhn et al. | 335/197 |

*Primary Examiner*—Harold Broome

[57] ABSTRACT

Electromagnetically operated contactor employing contact modules which are converted from normally open to normally closed and from normally closed to normally open operation by inverting the contact module in the contactor. The contact terminals of the contact module are clamped by various arrangements against conductive members of the contactor. Wiring terminals for connecting external wiring to the conductive members are spaced from the arrangement for clamping the contact terminals to the conductive members. Thus, the wiring terminals and the external wiring do not interfere with the module or arrangement for clamping, and the module may be removed, inverted, and replaced without disturbing the external wiring connections.

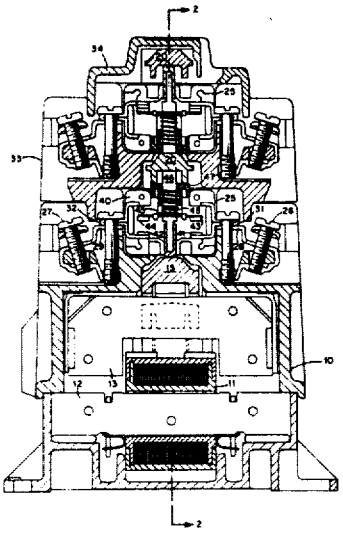

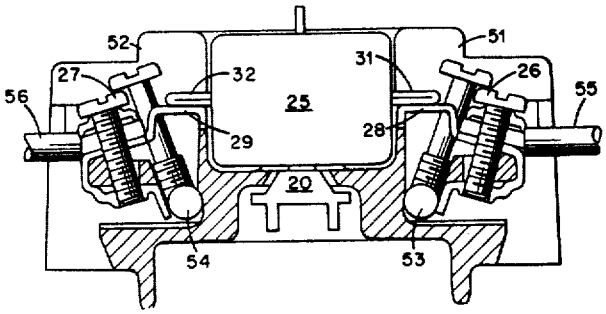

REEXAMINATION CERTIFICATE ISSUED UNDER 35 U.S.C. 307.

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 2, having been finally determined to be unpatentable, are cancelled.

Claims 3 and 4 are determined to be patentable as amended:

Claims 5–10, dependent on amended claims, are determined to be patentable.

New claims 11–19 are added and determined to be patentable.

3. An electrical switching apparatus [in accordance with claim 2] *having a convertible contact module for selectively providing normally open or normally closed contact operation comprising*

*supporting structure;*

*a contact actuator mounted in said supporting structure and reciprocally movable with respect thereto;*

*a convertible contact module having first and second contact terminals on the exterior thereof, said convertible contact module being removably mounted in said supporting structure in engagement with said contact actuator in either of two positions respectively providing normally open and normally closed contact conditions between said contact terminals;*

*first and second conductive members mounted on said supporting structure, each having a contact region for making contact with a contact terminal of the convertible contact module when the convertible contact module is mounted in the supporting structure in either of said two positions;*

*holding means for releasably holding the convertible contact module in the supporting structure in either of said two positions with the contact terminals of the convertible contact module making electrical contact with the contact regions of the conductive members; and*

*first and second connecting means on said first and second conductive members, respectively, for permitting external connections to said conductive members, each connecting means being spaced from the associated contact region and from the holding means whereby when said convertible contact module is released by said holding means, removed from the supporting structure, and changed from one position to the other, the connecting means and external connections made thereto do not interfere with release and movement of the convertible contact module and are not disturbed;*

*wherein*

*said contact actuator is reciprocally movable between two spaced positions;*

*said convertible contact module includes*

*a housing,*

*said contact terminals being mounted on said housing at opposite sides thereof and extending outwardly from said housing, said contact terminals passing through the housing to the interior thereof, and*

*contact elements within said housing engaging said contact actuator when the convertible contact module is mounted in the supporting structure in either first or second respectively inverted positions, the convertible contact module being in a normally open condition with the contact elements providing an open circuit between the contact terminals when mounted in one position and being in a normally closed condition with the contact elements providing a closed circuit between the contact terminals when mounted in the other position; and*

*said contact actuator moves the contact elements to produce a closed circuit between the contact terminals of a convertible contact module in the normally open condition upon movement from one spaced position to the other spaced position, and moves the contact elements to produce an open circuit between the contact terminals of a convertible contact module in the normally closed condition upon movement from the one spaced position to the other spaced position;*

*and* wherein the portion of each contact terminal of the convertible contact module exterior of the housing has generally flat planar opposite surfaces, and the corresponding surfaces of the two contact terminals lie generally in the same plane; and the contact regions of the two conductive members lie generally in the same plane whereby when the convertible contact module is mounted in the supporting structure in either of the two inverted positions, a surface of each contact terminal is in electrical contact with a contact region of a conductive member.

4. An electrical switching apparatus in accordance with claim 3 wherein said [housing] *holding* means for releasably holding the convertible contact module in the supporting structure includes fastening means for releasably clamping each contact terminal against the contact region of a conductive member.

*11. An electrical switching apparatus having a convertible contact module for selectively providing normally open or normally closed contact operation comprising*

*supporting structure;*

*a contact actuator mounted in said supporting structure and reciprocally movable with respect thereto;*

*a convertible contact module including a housing and having first and second contact terminals immovably mounted in fixed position with respect to said housing on the exterior thereof, said convertible contact module being removably mounted in said supporting structure in engagement with said contact actuator in either of two positions respectively providing normally open and normally closed contact conditions between said contact terminals;*

*first and second conductive members mounted on said supporting structure, each having a contact region for making contact with a contact terminal of the convertible contact module when the convertible contact mod-*

*ule is mounted in the supporting structure in either of said two positions;*

*holding means for releasably holding the convertible contact module in the supporting structure in either of said two positions with the contact terminals of the convertible contact module making electrical contact with the contact regions of the conductive members; and*

*first and second connecting means on said first and second conductive members, respectively, for permitting external connections to said conductive members, each connecting means being spaced from the associated contact region and from the holding means whereby when said convertible contact module is released by said holding means, removed from the supporting structure, and changed from one position to the other, the connecting means and external connections made thereto do not interfere with release and movement of the convertible contact module and are not disturbed.*

*12. An electrical switching apparatus in accordance with claim 11 wherein*

*said contact actuator is reciprocally movable between two spaced positions;*

*said convertible contact module includes*

*said contact terminals being immovably mounted on said housing at opposite sides thereof in fixed position with respect thereto and extending outwardly from said housing, said contact terminals passing through the housing to the interior thereof, and*

*contact elements within said housing engaging said contact actuator when the convertible contact module is mounted in the supporting structure in either first or second respectively inverted positions, the convertible contact module being in a normally open condition with the contact elements providing an open circuit between the contact terminals when mounted in one position and being in a normally closed condition with the contact elements providing a closed circuit between the contact terminals when mounted in the other position; and*

*said contact actuator moves the contact elements to produce a closed circuit between the contact terminals of a convertible contact module in the normally open condition upon movement from one spaced position to the other spaced position, and moves the contact elements to produce an open circuit between the contact terminals of a convertible contact module in the normally closed condition upon movement from the one spaced position to the other spaced position.*

*13. An electrical switching apparatus in accordance with claim 12 wherein*

*the portion of each contact terminal of the convertible contact module exterior of the housing has generally flat planar opposite surfaces, and the corresponding surfaces of the two contact terminals lie generally in the same plane; and*

*the contact regions of the two conductive members lie generally in the same plane whereby when the convertible contact module is mounted in the supporting structure in either of the two inverted positions, a surface of each contact terminal is in electrical contact with a contact region of a conductive member.*

*14. An electrical switching apparatus in accordance with claim 13 wherein*

*said holding means for releasably holding the convertible contact module in the supporting structure includes fastening means for releasably clamping each contact terminal against the contact region of a conductive member.*

*15. An electrical switching apparatus having a convertible contact module for selectively providing normally open or normally closed contact operation comprising*

*supporting structure;*

*a contact actuator mounted in said supporting structure and reciprocally movable with respect thereto;*

*a convertible contact module having first and second contact terminals in fixed position on the exterior thereof, said convertible contact module being removably mounted in said supporting structure in engagement with said contact actuator in either of two positions respectively providing normally open and normally closed contact conditions between said contact terminals;*

*first and second conductive members mounted on said supporting structure, each having a contact region for making contact with a contact terminal of the convertible contact module when the convertible contact module is mounted in the supporting structure in either of said two positions;*

*holding means for releasably holding the convertible contact module in the supporting structure in either of said two positions with the contact terminals of the convertible contact module making electrical contact with the contact regions of the conductive members; and*

*first and second connecting means on said first and second conductive members, respectively, for permitting external connections to said conductive members, each connecting means being spaced from the associated contact region and from the holding means whereby when said convertible contact module is released by said holding means, removed from the supporting structure, and changed from one position to the other, the connecting means and external connections made thereto do not interfere with release and movement of the convertible contact module and are not disturbed;*

*wherein*

*said holding means for releasably holding the convertible contact module in the supporting structure includes fastening means for releasably clamping each contact terminal against the contact region of a conductive member.*

*16. An electrical switching apparatus in accordance with claim 15 wherein*

*said contact actuator is reciprocally movable between two spaced positions;*

*said convertible contact module includes*

*a housing,*

*said contact terminals being mounted on said housing at opposite sides thereof in fixed position with respect thereto and extending outwardly from said housing, said contact terminals passing through the housing to the interior thereof, and*

*contact elements within said housing engaging said contact actuator when the convertible contact module is mounted in the supporting structure in either first or second respectively inverted positions, the convertible contact module being in a normally open condition with the contact elements providing an open circuit between the contact terminals when mounted in one position and being in a normally closed condition with the contact elements providing a closed circuit between the contact terminals when mounted in the other position; and*

*said contact actuator moves the contact elements to produce a closed circuit between the contact terminals of a convertible contact module in the normally open condition upon movement from one spaced position to the other spaced position, and moves the contact elements to produce an open circuit between the contact terminals of a convertible contact module in the normally closed condition upon movement from the one spaced position to the other spaced position.*

*17. An electrical switching apparatus in accordance with claim 16 wherein*

*the portion of each contact terminal of the convertible contact module exterior of the housing has generally flat planar opposite surfaces, and the corresponding surfaces of the two contact terminals lie generally in the same plane; and*

*the contact regions of the two conductive members lie generally in the same plane whereby when the convertible contact module is mounted in the supporting structure in either of the two inverted positions, a surface of each contact terminal is in electrical contact with a contact region of a conductive member.*

*18. An electrical switching apparatus in accordance with claim 17 wherein*

*said fastening means includes first and second binding means;*

*each binding means being adapted to be tightened to clamp a contact terminal in physical and electrical contact with the contact region of a conductive member.*

*19. An electrical switching apparatus in accordance with claim 17 wherein*

*said fastening means includes first and second externally threaded members each having externally threaded portions and first and second internally threaded members each having a threaded opening for mating with an externally threaded portion of an externally threaded member;*

*each of said externally threaded members being adapted to be tightened in an associated internally threaded member to fasten a convertible contact module in the supporting structure and to clamp each contact terminal in physical and electrical contact with the contact region of a conductive member.*

* * * * *